US007896340B2

(12) United States Patent
Learmonth et al.

(10) Patent No.: US 7,896,340 B2
(45) Date of Patent: Mar. 1, 2011

(54) PRINT MEDIA REGISTRATION SYSTEM AND METHOD

(75) Inventors: Murray Learmonth, San Diego, CA (US); David R. Meyer, San Diego, CA (US); Dentarg Huang, Taipei (TW); Kirby Wang, Taipei (TW); Robert J. Lockwood, San Diego, CA (US); Tsai-Yi Lin, Taipei (TW)

(73) Assignee: Hewlett-Packard Development Company, L.P., Houston, TX (US)

( * ) Notice: Subject to any disclaimer, the term of this patent is extended or adjusted under 35 U.S.C. 154(b) by 140 days.

(21) Appl. No.: 11/894,230

(22) Filed: Aug. 20, 2007

(65) Prior Publication Data

US 2009/0051099 A1 Feb. 26, 2009

(51) Int. Cl.
*B65H 9/04* (2006.01)

(52) U.S. Cl. ..... 271/242; 271/10.02; 271/10.12

(58) Field of Classification Search ..... 271/10.02, 271/145, 3.15, 3.16, 242, 244, 10.03, 10.12, 271/270; 399/23, 395; 400/619, 630
See application file for complete search history.

(56) References Cited

U.S. PATENT DOCUMENTS

| | | | | |
|---|---|---|---|---|
| 5,507,478 | A * | 4/1996 | Nottingham et al. | 271/10.02 |
| 5,597,155 | A | 1/1997 | Guido et al. | |
| 5,775,690 | A | 7/1998 | Quesnel et al. | |
| 5,842,694 | A | 12/1998 | Brooks et al. | |
| 5,971,390 | A | 10/1999 | Caspar et al. | |
| 6,227,534 | B1 * | 5/2001 | Schoedinger et al. | 271/114 |
| 6,533,263 | B2 * | 3/2003 | Tamura | 271/10.01 |
| 6,567,620 | B2 * | 5/2003 | Brown et al. | 399/18 |
| 6,974,128 | B2 | 12/2005 | Quesnel | |
| 6,994,341 | B2 * | 2/2006 | Aoki et al. | 271/117 |
| 7,003,258 | B2 | 2/2006 | Adachi et al. | |
| 7,237,772 | B2 * | 7/2007 | Kamamura | 271/9.01 |
| 2001/0022422 | A1 * | 9/2001 | Tamura | 271/10.03 |
| 2003/0184003 | A1 * | 10/2003 | Asada et al. | 271/121 |
| 2004/0150154 | A1 * | 8/2004 | Howe | 271/228 |
| 2005/0082740 | A1 | 4/2005 | Stevens | |
| 2006/0163801 | A1 | 7/2006 | Dejong et al. | |
| 2006/0261540 | A1 | 11/2006 | Loiselle et al. | |
| 2007/0052155 | A1 * | 3/2007 | Cook et al. | 271/152 |
| 2008/0237979 | A1 * | 10/2008 | Tamura et al. | 271/270 |
| 2008/0240821 | A1 * | 10/2008 | Shoji et al. | 399/395 |

FOREIGN PATENT DOCUMENTS

| | | |
|---|---|---|
| JP | 06048594 | 2/1994 |
| JP | 09194079 | 7/1997 |
| JP | 2000242046 | 9/2000 |

* cited by examiner

*Primary Examiner* — Stefanos Karmis
*Assistant Examiner* — Jeremy Severson

(57) ABSTRACT

A system for registering print media includes a media tray configured to hold a plurality of sheets of print media, a pick assembly configured to pick a sheet of the print media from the media tray and route the sheet to a media path, and a registration assembly positioned in the media path after the pick assembly. The registration assembly is configured to sense the sheet in the media path and operate for a predetermined time based on an amount of the print media in the media tray to register the sheet in the media path such that the predetermined time increases as the amount of the print media in the media tray decreases.

24 Claims, 5 Drawing Sheets

PRINT MEDIA REGISTRATION SYSTEM AND METHOD

BACKGROUND

In a printing system for printing on print media, it is desirable for the print media to be aligned as accurately as possible to register the print media for feeding through the printing system. Deviations from aligned or straight feeding of the print media can result in image skew. More specifically, misalignment of the print media can result in an image that is printed on the print media as being tilted or angled relative to the print media. Accordingly, registering the print media to align or deskew the print media before printing of the image on the print media is desirable.

For these and other reasons, a need exists for the present invention.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
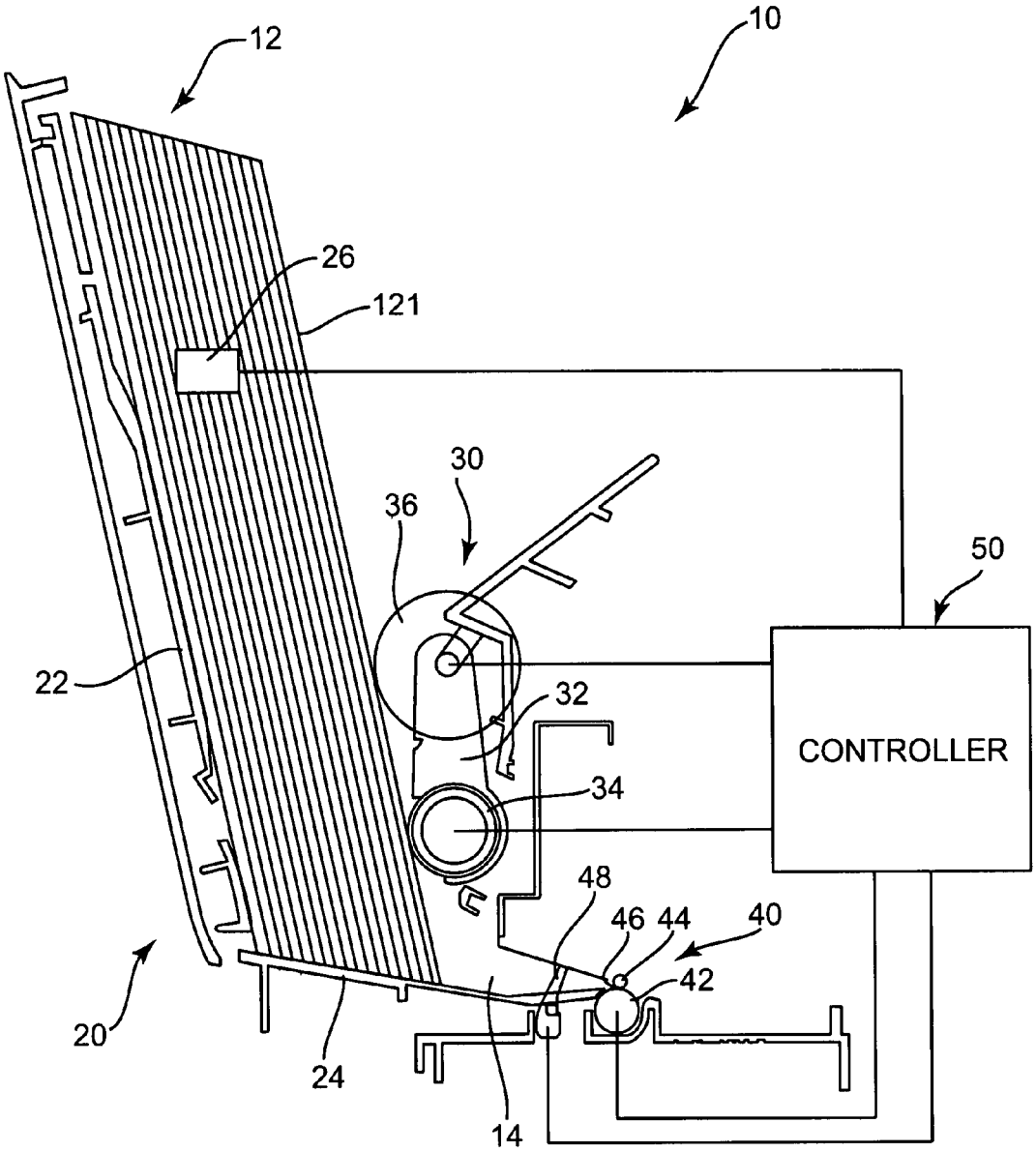
FIG. 1 is a schematic cross-sectional view illustrating one embodiment of a portion of a printing system including one embodiment of a print media registration system.

FIG. 1 schematically illustrates one embodiment of a portion of a printing system 10. Printing system 10 is defined to include any device or system capable of producing or generating printed output such as, for example, an ink jet printer, a laser printer, a thermal transfer printer, or a multi-functional device providing printing, copying, and/or scanning capabilities.

In one embodiment, printing system 10 includes a media tray 20, a pick assembly 30, a registration assembly 40, and a controller 50. As described below, media tray 20, pick assembly 30, and registration assembly 40 are arranged and configured to supply print media 12 to a media path 14 of printing system 10 for printing on print media 12. More specifically, media tray 20 holds print media 12 and pick assembly 30 picks a sheet of print media 12 and routes print media 12 to media path 14. Registration assembly 40 is positioned in media path 14 after pick assembly 30 and senses print media 12 in media path 14. As such, registration assembly 40 registers print media 12 in media path 14, and then advances print media 12 along media path 14, as described below.

In one embodiment, media tray 20 supports or holds a plurality of sheets of print media 12 in a stacked arrangement or configuration. The stacked arrangement or configuration of print media 12 results in a stack height of print media 12. Accordingly, the stack height of print media 12 varies based on a quantity or amount of print media 12 held by media tray 20. In one exemplary embodiment, media tray 20 holds between 1 and 100 sheets of print media 12.

In one embodiment, media tray 20 includes a backing plate 22 and a transition plate 24. Backing plate 22 and transition plate 24 are arranged such that backing plate 22 supports a surface of print media 12 and transition plate 24 supports an edge of print media 12. In one exemplary embodiment, transition plate 24 extends from backing plate 22 in a horizontal manner and guides print media 12 to media path 14.

In one embodiment, backing plate 22 is oriented at an angle to horizontal. In one exemplary embodiment, the angle of backing plate 22 is an obtuse angle. As such, in the exemplary embodiment, print media 12 supported by media tray 20 is oriented in a vertical manner at an angle corresponding to the angle of backing plate 22.

In one embodiment, pick assembly 30 includes a pick arm 32 and a pick roller 34. Pick roller 34 is supported by pick arm 32 and contacts a top sheet 121 of the stack of print media 12 to pick top sheet 121 of print media 12 from the stack. In one embodiment, pick arm 32 is an articulating arm and is biased toward backing plate 22 of media tray 20 such that pick arm 32 moves toward backing plate 22 as print media 12 is removed from media tray 20.

In one embodiment, pick assembly 30 also includes a spacer wheel 36. Spacer wheel 36 is supported by pick arm 32 and maintains contact with a top sheet of the stack of print media 12 as print media 12 is removed from media tray 20. As such, spacer wheel 36 and, therefore, pick arm 32 follow the stack height of print media 12. Thus, in one embodiment, a stack height and/or a quantity or amount of print media 12 held in or supported by media tray 20 is determined from the position of pick arm 32. Although only one pick roller 34 and one spacer wheel 36 are illustrated and described, it is within the scope of the present invention for pick assembly 30 to include one or more pick rollers 34 and/or one or more spacer wheels 36.

In another embodiment, printing system 10 includes a media tray sensor 26. Media tray sensor 26 senses print media 12 in media tray 20 and provides feedback and/or input regarding a stack height and/or a quantity or amount of print media 12 held in or supported by media tray 20. In one embodiment, media tray sensor 26 includes a low media sensor of printing system 10.

In one embodiment, the position of pick arm 32 and/or input from media tray sensor 26 is used to determine a stack height and/or a quantity or amount of print media 12 held in or supported by media tray 20. As such, the stack height and/or quantity or amount of print media 12 held in or supported by media tray 20 is used to control operation of registration assembly 40, as described below.

In one embodiment, registration assembly 40 includes a feed roller 42 and a pinch roller 44. Pinch roller 44 is positioned opposite feed roller 42 such that feed roller 42 and pinch roller 44 form a nip 46 therebetween. As described below, pick assembly 30 routes print media 12 to nip 46 such that registration assembly 40 registers print media 12 in media path 14. Thereafter, registration assembly 40 advances print media 12 along media path 14. Although only one feed roller 42 and one pinch roller 44 are illustrated and described, it is within the scope of the present invention for registration assembly 40 to include one or more feed rollers 42 and/or one or more pinch rollers 44.

In one embodiment, registration assembly 40 also includes a media path sensor 48. Media path sensor 48 senses print media 12 in media path 14 and provides feedback or input for operating registration assembly 40 and, more specifically, feed roller 42 of registration assembly 40, as described below.

In one embodiment, controller 50 communicates with pick assembly 30 and registration assembly 40 to control operation of pick assembly 30 and registration assembly 40, as described below. More specifically, in one embodiment, controller 50 communicates with pick arm 32 and pick roller 34 of pick assembly 30, and communicates with feed roller 42 and media path sensor 48 of registration assembly 40. As such, controller 50 receives feedback or input from pick arm 32 regarding a position of pick arm 32, and provides output to pick roller 34 for operation of pick roller 34 and picking of print media 12 from media tray 20. In addition, controller 50 receives feedback or input from media path sensor 48 regarding a position of print media 12 in media path 14, and provides output to feed roller 42 for operation of feed roller 42 and registering of print media 12 in media path 14.

In one embodiment, with input of the position of pick arm 32 or input from media tray sensor 26, controller 50 determines a stack height and/or a quantity or amount of print media 12 held in or supported by media tray 20. In addition, with input of media path sensor 48, controller 50 determines a position of print media 12 in media path 14. As such, based on the stack height and/or quantity or amount of print media 12 held in or supported by media tray 20 and the position of print media 12 in media path 14, controller 50 provides output to feed roller 42 for registering print media 12 in media path 14, as described below.

Figure 2:
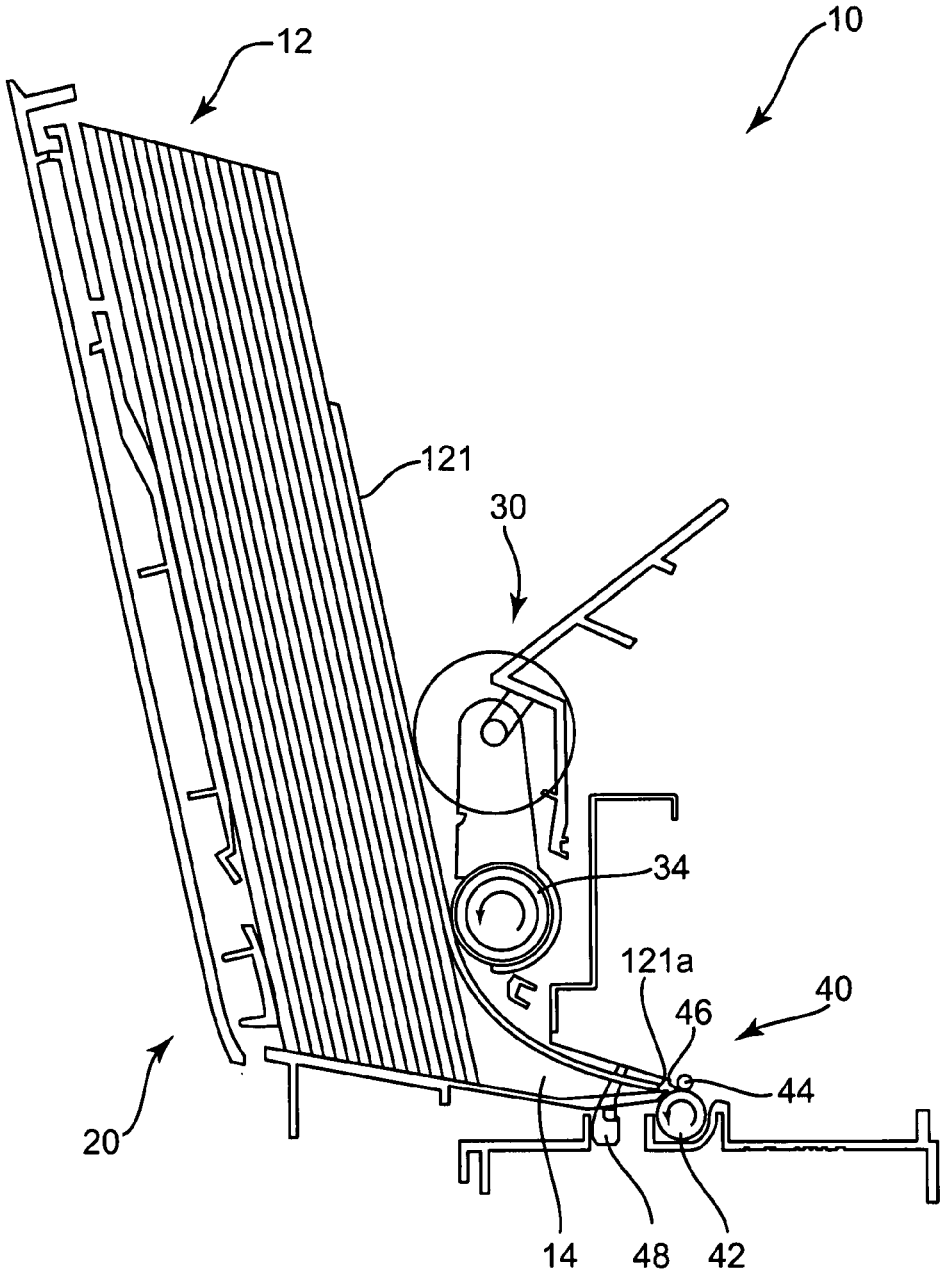
FIG. 2 is a schematic cross-sectional view illustrating one embodiment of operation of the print media registration system of FIG. 1.
Figure 3:
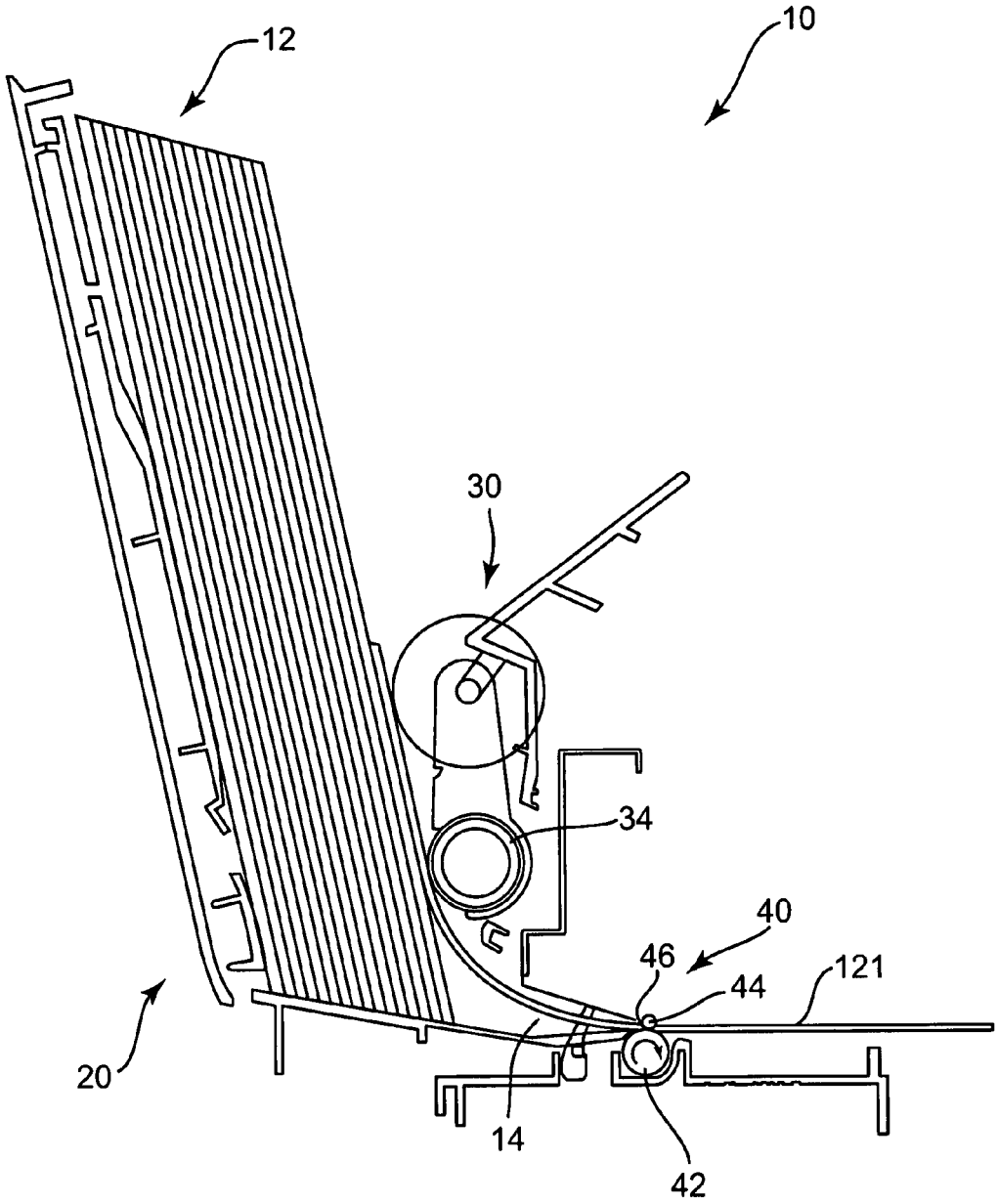
FIG. 3 is a schematic cross-sectional view illustrating one embodiment of further operation of the print media registration system of FIG. 2.

FIGS. 2 and 3 illustrate one embodiment of operation of printing system 10 including, more specifically, picking, registering, and feeding of print media 12 in printing system 10. As illustrated in the embodiment of FIG. 2, pick roller 34 of pick assembly 30 is operated to pick top sheet 121 of print media 12 from media tray 20 and route top sheet 121 to media path 14 and nip 46 between feed roller 42 and pinch roller 44 of registration assembly 40. In the illustrated embodiment, pick roller 34 is rotated counterclockwise to pick top sheet 121 of print media 12 and route top sheet 121 to media path 14 and nip 46. As such, top sheet 121 of print media 12 is routed to nip 46 in a first direction.

In one embodiment, after media path sensor 48 senses a leading edge 121*a* of top sheet 121 in media path 14, feed roller 42 of registration assembly 40 is operated to register top sheet 121 in media path 14. More specifically, in the illustrated embodiment, feed roller 42 is rotated counterclockwise in a second direction opposite the first direction. As such, nip 46 between feed roller 42 and pinch roller 44 is driven opposite to the direction in which top sheet 121 is fed to nip 46. Thus, feed roller 42 and pinch roller 44 register top sheet 121 in media path 14. In registering top sheet 121 in media path 14, feed roller 42 and pinch roller 44 deskew or align top sheet 121 in media path 14.

In one embodiment, registration assembly 40 is operated for a predetermined time based on the quantity or amount of print media 12 in media tray 20 to register print media 12 in media path 14. More specifically, as the quantity or amount of print media 12 in media tray 20 decreases, the predetermined time that registration assembly 40 is operated to register print media 12 in media path 14 increases, as described below.

As illustrated in the embodiment of FIG. 3, after registration assembly 40 has been operated for the predetermined time to register print media 12 in media path 14, pick assembly 30 is released and registration assembly 40 is operated to advance top sheet 121 of print media 12 along media path 14. More specifically, in the illustrated embodiment, pick roller 34 is idled and feed roller 42 is rotated clockwise. As such, nip 46 between feed roller 42 and pinch roller 44 is driven in the first direction. Thus, feed roller 42 and pinch roller 44 advance top sheet 121 along media path 14 in the first direction.

Figure 4:
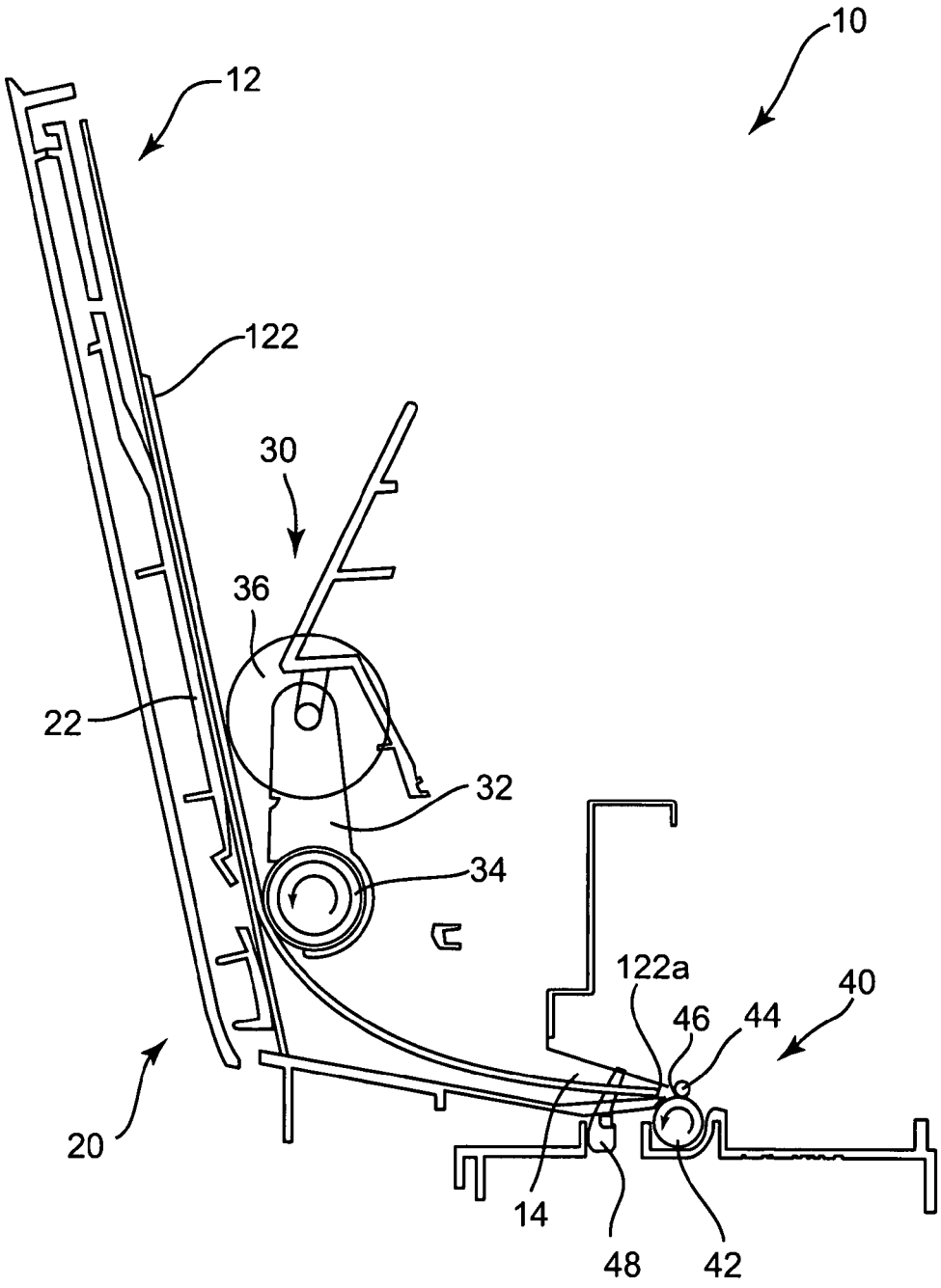
FIG. 4 is a schematic cross-sectional view illustrating another embodiment of operation of the print media registration system of FIG. 1.
Figure 5:
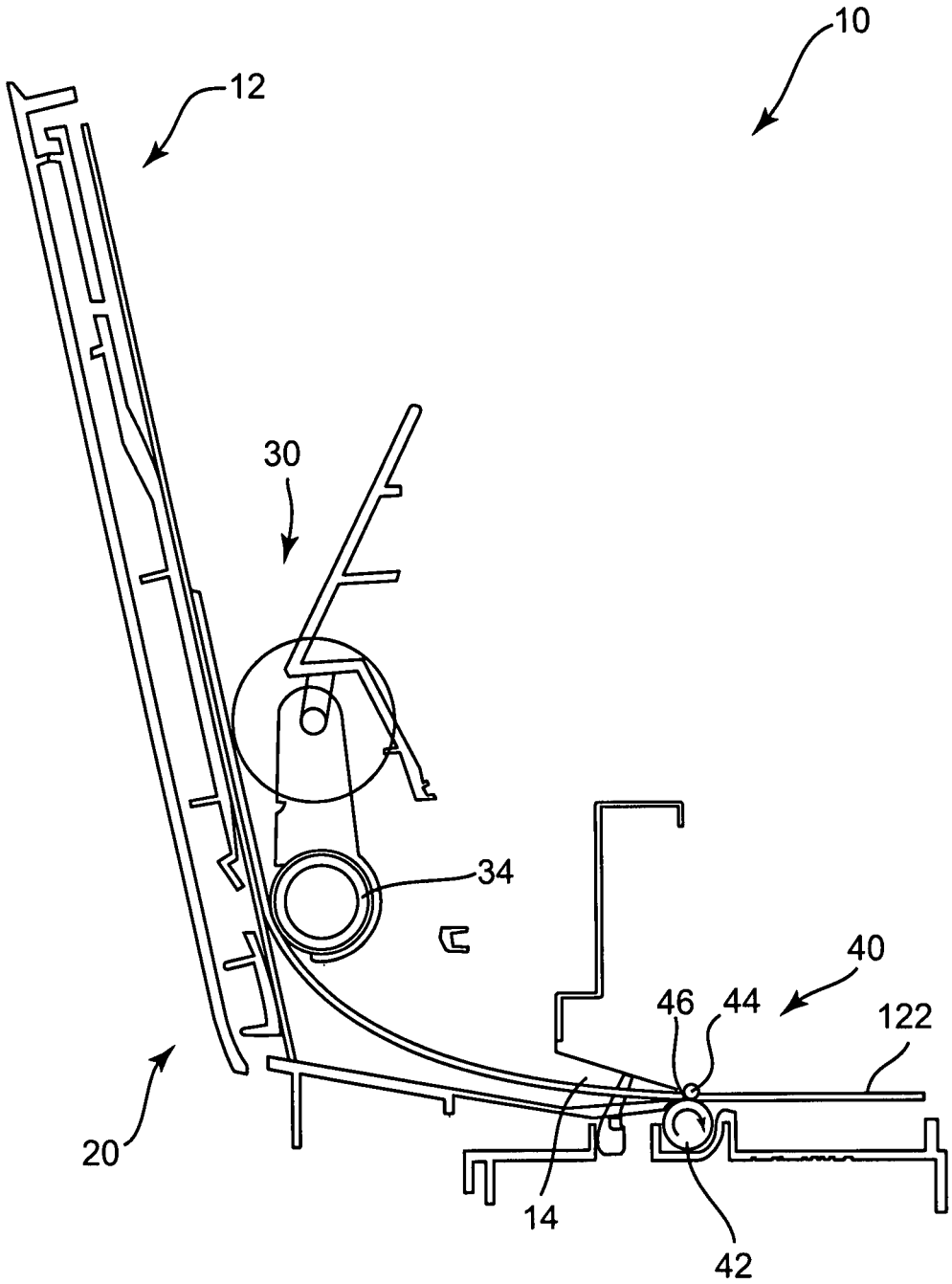
FIG. 5 is a schematic cross-sectional view illustrating one embodiment of further operation of the print media registration system of FIG. 4.

FIGS. 4 and 5 illustrate another embodiment of operation of printing system 10, including, more specifically, picking, registering, and feeding of print media 12 in printing system 10. As illustrated in the embodiment of FIGS. 4 and 5, the stack height and/or the quantity or amount of print media 12 in media tray 20 is less than that of the embodiment of FIGS. 2 and 3. For example, in one exemplary embodiment, FIGS. 2 and 3 include a stack height of approximately 100 sheets of print media 12 whereas FIGS. 4 and 5 illustrate a stack height of approximately 10 sheets of print media 12.

As illustrated in the embodiment of FIG. 4, pick roller 34 of pick assembly 30 is operated to pick a top sheet 122 of print media 12 from media tray 20 and route top sheet 122 to media path 14 and nip 46 between feed roller 42 and pinch roller 44 of registration assembly 40. In the illustrated embodiment, pick roller 34 is rotated counterclockwise to pick top sheet 122 of print media 12 and route top sheet 122 to media path 14 and nip 46. As such, top sheet 122 of print media 12 is routed to nip 46 in a first direction.

In one embodiment, after media path sensor 48 senses a leading edge 122*a* of top sheet 122 in media path 14, feed roller 42 of registration assembly 40 is operated to register top sheet 122 in media path 14. More specifically, in the illustrated embodiment, feed roller 42 is rotated counterclockwise in a second direction opposite the first direction. As such, nip 46 between feed roller 42 and pinch roller 44 is driven opposite to the direction in which top sheet 122 is fed to nip 46. Thus, feed roller 42 and pinch roller 44 register top sheet 122 in media path 14. In registering top sheet 122 in media path 14, feed roller 42 and pinch roller 44 deskew or align top sheet 122 in media path 14.

As described above, registration assembly 40 is operated for a predetermined time based on the quantity or amount of print media 12 in media tray 20 to register print media 12 in media path 14. More specifically, as the quantity or amount of print media 12 in media tray 20 decreases, the predetermined time that registration assembly 40 is operated to register print media 12 in media path 14 increases, as described below.

In one embodiment, as described above, pick arm 32 is an articulating arm and is biased toward backing plate 22 of media tray 20 such that spacer wheel 36 maintains contact with a top sheet of print media 12. As such, with a reduced stack height of print media 12, pick arm 32 moves closer to backing plate 22. Thus, compared to the higher stack height of print media 12 in the embodiment of FIG. 2, a distance of media path 14 from pick roller 34 to feed roller 42 is greater with the lower stack height of print media 12 in the embodiment of FIG. 4.

Accordingly, with the lower stack height of print media 12 in the embodiment of FIG. 4, a longer uncontrolled length of top sheet 122 of print media 12 exists. As a result, a degree or amount of skew or misalignment of top sheet 122 maybe greater in the embodiment of FIG. 4 than a degree or amount of skew or misalignment of top sheet 121 in the embodiment of FIG. 2. Thus, the predetermined time that registration assembly 40 is operated to register top sheet 122 of print media 12 in media path 14 in the embodiment of FIG. 4 is greater than the predetermined time that registration assembly 40 is operated to register top sheet 121 of print media 12 in media path 14 in the embodiment of FIG. 2.

As illustrated in the embodiment of FIG. 5, after registration assembly 40 has been operated for the predetermined time to register print media 12 in media path 14, pick assembly 30 is released and registration assembly 40 is operated to advance top sheet 122 of print media 12 along media path 14. More specifically, in the illustrated embodiment, pick roller 34 is idled and feed roller 42 is rotated clockwise. As such, nip 46 between feed roller 42 and pinch roller 44 is driven in the first direction. Thus, feed roller 42 and pinch roller 44 advance top sheet 122 along media path 14 in the first direction.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A system for registering print media, comprising:

a media tray configured to hold a plurality of sheets of print media;

a pick assembly configured to pick a sheet of the print media from the media tray and route the sheet to a media path;

a registration assembly positioned in the media path after the pick assembly; and a media path sensor positioned in the media path after the pick assembly and before the registration assembly, wherein the media path sensor is configured to sense a leading edge of the sheet in the media path; and a controller configured to operate the registration assembly for a predetermined time based on an amount of the print media in the media tray after the media path sensor senses the leading edge of the sheet in the media path to register the sheet in the media path, wherein the predetermined time increases as the amount of the print media in the media tray decreases.

2. The system of claim 1, further comprising:

a media tray sensor configured to sense the amount of the print media in the media tray.

3. The system of claim 1, wherein the amount of the print media in the media tray is determined from a stack height of the print media in the media tray.

4. The system of claim 1, wherein the pick assembly includes a pick arm and a pick roller supported by the pick arm, wherein the pick roller is configured to contact the plurality of sheets of print media and pick the sheet of the print media from the media tray, and wherein the amount of the print media in the media tray is determined from a position of the pick arm.

5. The system of claim 1, wherein the media tray includes a backing plate arranged to support a surface of the print media and a transition plate arranged to support an edge of the print media, wherein the transition plate extends from the backing plate in a horizontal manner and guides the print media to the media path, and the backing plate is oriented at an obtuse angle to horizontal such that print media supported by the media tray is oriented in a vertical manner at an angle corresponding to the angle of the backing plate.

6. The system of claim 1, wherein the registration assembly includes a feed roller and a pinch roller positioned opposite the feed roller, wherein the feed roller and the pinch roller form a nip therebetween, wherein the pick assembly is configured to route the sheet to the nip in a first direction, and wherein the registration assembly is configured to rotate the feed roller in a second direction opposite the first direction for the predetermined time to register the sheet in the media path.

7. The system of claim 6, wherein the registration assembly is configured to rotate the feed roller in the first direction and advance the sheet along the media path in the first direction after the predetermined time.

8. The system of claim 1, wherein the registration assembly is configured to deskew the sheet of the print media in the media path.

9. A system for registering print media, comprising:

means for holding a plurality of sheets of print media;

means for picking a sheet of the print media from the plurality of sheets of print media and routing the sheet to a media path; and means positioned in the media path for sensing a leading edge of the sheet in the media path and registering the sheet in the media path, wherein the means for sensing and registering is configured to operate for a predetermined time based on an amount of the print media held by the means for holding after sensing the leading edge of the sheet in the media path, wherein the predetermined time increases as the amount of the print media held by the means for holding decreases.

10. The system of claim 9, further comprising:

means for determining the amount of the print media held by the means for holding.

11. The system of claim 10, wherein the means for determining includes means for determining a stack height of the print media held by the means for holding.

12. The system of claim 10, wherein the means for determining includes the means for picking and routing the sheet.

13. The system of claim 9, wherein the means for holding the print media includes means for supporting the print media in a vertical manner at an obtuse angle to horizontal and guiding the print media to the media path in a horizontal manner.

14. The system of claim 9, wherein the means for picking and routing is configured to route the sheet to the media path in a first direction, and wherein the means for sensing and registering is configured to operate in a second direction opposite the first direction for the predetermined time.

15. The system of claim 14, wherein the means for sensing and registering is configured to advance the sheet along the media path in the first direction after the predetermined time.

16. The system of claim 9, wherein the means for sensing and registering is configured to deskew the sheet of the print media in the media path.

17. A method of registering print media, comprising:

holding a plurality of sheets of print media;

picking a sheet of the print media from the plurality of sheets of print media and routing the sheet to a media path;

sensing a leading edge of the sheet in the media path with a sensor positioned in the media path; and registering the sheet in the media path, including performing the registering for a predetermined time based on an amount of the print media in the plurality of sheets of print media after sensing the leading edge of the sheet in the media path, wherein the predetermined time increases as the amount of the print media in the plurality of sheets of print media decreases.

18. The method of claim 17, further comprising:

determining the amount of the print media in the plurality of sheets of print media.

19. The method of claim 18, wherein determining the amount of the print media includes determining a stack height of the print media.

20. The method of claim 18, wherein determining the amount of the print media includes determining the amount of the print media from the picking the sheet of the print media.

21. The method of claim 17, wherein holding the print media includes orienting a backing plate at an obtuse angle to horizontal and extending a transition plate in a horizontal manner from the backing plate, the backing plate supporting a surface of the print media and the transition plate supporting an edge of the print media, wherein the transition plate guides the print media to the media path.

22. The method of claim 17, wherein routing the sheet to the media path includes routing the sheet in a first direction, and wherein registering the sheet in the media path includes performing the registering in a second direction opposite the first direction for the predetermined time.

23. The method of claim 22, further comprising:

advancing the sheet along the media path in the first direction after the predetermined time.

24. The method of claim 17, wherein registering the sheet in the media path includes deskewing the sheet of the print media in the media path.

* * * * *